US005992273A

United States Patent [19]

Galea

[11] Patent Number: 5,992,273

[45] Date of Patent: Nov. 30, 1999

[54] ADJUSTABLE LOCKING PLIERS

[76] Inventor: Armand Galea, 312 Lynch St., Olyphant, Pa. 18447

[21] Appl. No.: 08/658,724

[22] Filed: Jun. 5, 1996

[51] Int. Cl.[6] ..... B25B 7/12

[52] U.S. Cl. ..... 81/368; 81/324; 81/349; 81/374

[58] Field of Search ..... 81/318, 324, 325, 81/342, 347–349, 351, 367, 368, 374, 383.5, 395, 399–401

[56] References Cited

U.S. PATENT DOCUMENTS

| | | | |
|---|---|---|---|
| 673,605 | 5/1901 | Jacques | 81/400 X |
| 1,455,297 | 5/1923 | Lyons et al. | 81/348 X |
| 1,483,497 | 2/1924 | Whitfield | 81/349 |
| 2,312,947 | 3/1943 | Westman | 81/401 |
| 2,320,303 | 5/1943 | Ross | 81/401 |
| 2,443,153 | 6/1948 | Wells | 81/401 |
| 2,584,353 | 2/1952 | Keiser | 81/347 |
| 2,643,567 | 6/1953 | Johnson | 81/400 X |
| 3,824,882 | 7/1974 | Burthart | 81/401 |

*Primary Examiner*—James G. Smith
*Attorney, Agent, or Firm*—Patent & Trademark Services; Joseph H. McGlynn

[57] ABSTRACT

An improved set of adjustable locking pliers having two pivotally mounted jaws. A lock lever is pivotally mounted to one handle member and slidably retained in the longitudinal grooved portion of the opposite handle, and an adjustment screw threaded longitudinally into the grooved handle member bears upon the sliding end of the lever. Handle members are pivotally connected to retaining plates, said plates having a pin projecting between them with the jaws pivotally mounted and laterally disposed thereon. The gripping surfaces of the jaws interlock above the pin and meet flush in the locked position. The handle member having the adjustment screw has a curved end which spreads the bottom of the jaws apart in the locked position, thereby forcing the gripping surfaces together.

4 Claims, 1 Drawing Sheet

ADJUSTABLE LOCKING PLIERS

BACKGROUND OF THE INVENTION

The present invention relates generally to pliers, and particularly to adjustable, locking pliers with two pivotally mounted jaw portions activated by a single lever locking mechanism.

DESCRIPTION OF THE PRIOR ART

Various locking pliers are known in the prior art. Most employ some type of pivotal linkage to apply force to a jaw portion for gripping an object. Some prior art pliers have also featured an adjustment means to allow gripping objects of different sizes.

For example, U.S. Pat. No. 2,312,947 discloses a conventional vise grip device with a pivotal locking lever engaging a jaw, and an adjustment screw mounted in the handle portion of the pliers.

U.S. Pat. No. 2,444,153 describes locking pliers with jaws that retain parallelism of the gripping surface at different gripping positions.

Other relevant prior art includes U.S. Pat. No. 2,320,303, describing a gripping tool with jaws that can be removed and substituted with other jaws for different tasks; U.S. Pat. No. 3,284,882 discloses a set of pliers with an engaging jaw pivotally mounted to a threaded adjustment screw, thereby having the ability to be adjusted for different sizes of objects.

The prior art pliers, however, often are difficult to use because they have one immovable jaw member that cannot conform to fit into tight areas. Also, having only one jaw member engaged by the locking mechanism, the prior art pliers do not provide adequate gripping force in many situations. There remains a need for adjustable locking pliers with a jaw design that provides improved grip and ease of operation in otherwise difficult working situations.

SUMMARY OF THE INVENTION

The present invention is an improved set of adjustable locking pliers with two pivotally mounted jaw portions, capable of providing better grip and easier use in tight working areas. The invention comprises two handle portions, each pivotally mounted at one end to retaining plates that house the jaw portions. The jaw portions are laterally disposed along a pivot pin projecting between the retaining plates, and are shaped such that the gripping surface of the jaws meet flush in the locked position. A locking lever is pivotally mounted midway on one handle portion and slidably retained at the other end within a longitudinal grooved portion of the opposite handle. An adjustment screw is threaded longitudinally into the end of the latter handle portion and bears upon the end of the lock lever slidably retained therein.

The handle having the lock lever pivotally mounted thereto can be squeezed toward the opposite handle and locked into place by virtue of the force exerted on the lock lever by the end of the adjustment screw. This operation simultaneously rotates the retaining plates and moves the jaws into the locked position. The tightness of the grip can be changed by turning the adjustment screw.

Since both jaws are pivotally mounted and both individually activated by the locking mechanism, the jaw s can be maneuvered into tight areas and made to grip securely. The invention thus provides a distinct advantage over prior art locking pliers, which are notoriously awkward to use in small spaces.

Accordingly, it is an object of the present invention to provide an improved set of adjustable locking pliers.

It is also an object of this invention to provide locking pliers which can be used easily in small spaces.

It is a further object of this invention to provide locking pliers with two pivotally mounted and independently activated jaw portions which provide enhanced grip and usefulness in otherwise difficult work areas.

These and other objects and advantages of the present invention will become more apparent from the detailed description below, when taken in conjunction with the annexed drawings.

DESCRIPTION OF THE PREFERRED EMBODIMENT

Figure 1:
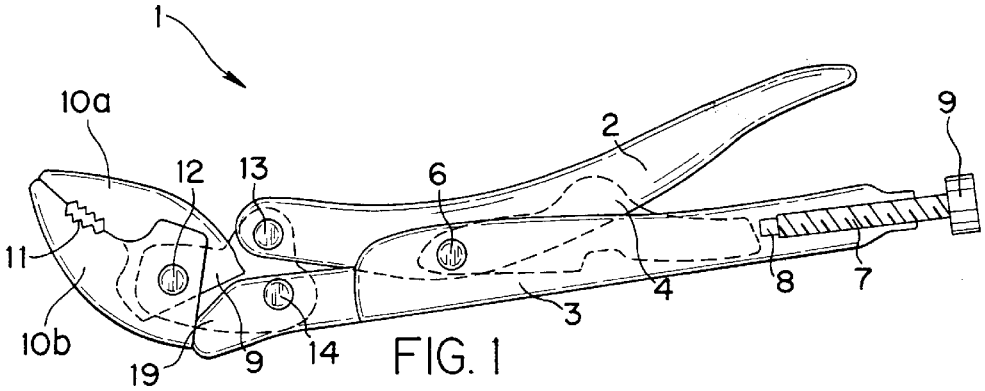
FIG. 1 shows a side view of the invention with the pliers in locked position, with shadow lines depicting obscured portions.
Figure 2:
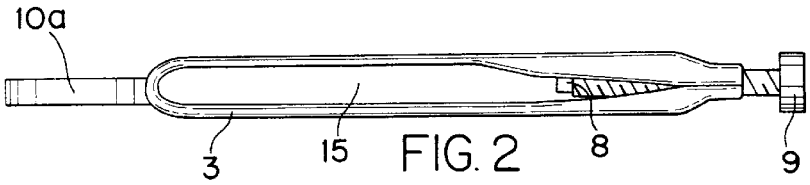
FIG. 2 shows a bottom view of the invention.
Figure 3:
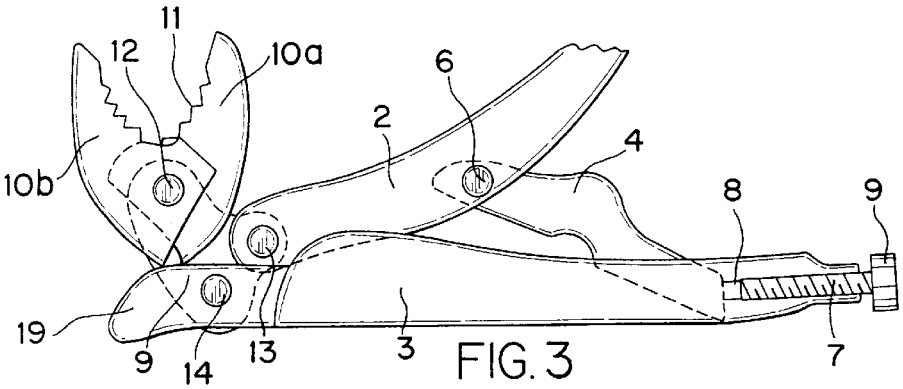
FIG. 3 shows a side view of the invention with the pliers in the open position, again with shadow lines depicting obscured portions.

Referring now to the drawings in greater detail, it can be seen in FIG. 1 that the present invention 1 comprises a curved handle member 2 and an opposite handle member 3, lock lever 4, and an adjustment screw 7. Curved handle member 2 and handle member 3 are pivotally connected at 13 and 14, respectively, to retaining plates 9 (only one of which is shown in FIGS. 1 and 3 for clarity) which house the jaws 10*a*, 10*b*. The handle members 2, 3 are hollow and generally U-shaped in cross section, thus each handle member has a longitudinal grooved portion 15, as best seen in FIG. 2. The handle member 3 receives the adjustment screw 7 and has a curved portion 19 at its opposite end, the function of which is described below.

As seen in FIGS. 1 and 3 taken together, a lock lever 4 is pivotally attached at 6 to the curved handle member 2, and is slidably retained at its other end within the grooved portion 15 of handle member 3. In the locked position as shown in FIG. 1, the lock lever 4 is brought to bear against the end portion 8 of the adjustment screw 7. The adjustment screw 7 is threaded into the handle member 3 and has a knob 9 at one end to facilitate turning the screw.

Figure 4:
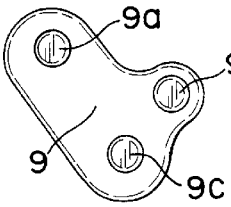
FIG. 4 shows a side view of one of the retaining plates of the present invention.

The jaws 10*a*, 10*b* are pivotally mounted on a pin 12 projecting between two retaining plates 9, as shown in FIGS. 1 and 3. One of the retaining plates 9 is depicted separately in FIG. 4, having openings 9*a*, 9*b*, 9*c* for receiving the pins 12, 13, 14, respectively. The jaws 10*a*, 10*b*, are laterally disposed along the pin 12, but are shaped such that the gripping surfaces 11 interlock and meet flush in the locked position, as shown in FIG. 1.

The invention 1 has an open position, shown in FIG. 3, and a locked position, shown in FIG. 1. In the locked position, the lock lever 4 is wedged between the adjustment screw end 8 and the pivot pin 6, thus holding the curved handle member 2 and the retaining plates 9 stationary.

As seen in FIG. 1, in the locked position the portions of the jaws 10*a*, 10*b* below the pivot pin 12 are disposed along the curved end 19 of the handle member 3 such that the gripping surfaces 11 are forced together. When the curved handle 2 is squeezed from the position shown in FIG. 3 to that shown in FIG. 1, the retaining plates 9 are rotated counterclockwise an d the angular displacement of the jaws 10*a*, 10*b* is closed, thereby pushing the gripping surfaces 11 together.

To use the invention 1, the jaws 10*a*, 10*b* are placed on the object to be grasped and the handle members 2, 3 are squeezed together, locking them in position. The tightness of the grip between the jaws 10*a*, 10*b* can be adjusted by turning the knob 9 of the adjustment screw 7. Since both jaws are pivotally mounted and independently activated, the jaws can be maneuvered into tight areas and made to grip where other pliers would be difficult or impossible to use. The invention 1 can be cast from any durable metal material, such as, but not limited to, stainless steel.

Although the locking pliers and the method of using the same according to the present invention have been described in the foregoing specification with considerable detail, it is to be understood that modifications may be made to the invention which do not exceed the scope of the appended claims and modified forms of the present invention done by others skilled in the art to which the invention pertains will be considered infringements of the invention when those modified forms fall within the claimed scope of the invention.

What I claim as my invention is:

1. Adjustable locking pliers comprising:

a first jaw having a gripping surface at one end and an abutment surface at another end, a first handle having a curved abutment surface on one end which engages said abutment surface on said first jaw, and said first handle has an adjustment means on another end, a second jaw having a gripping surface at one end, said gripping surface on said first jaw being oppositely disposed with respect to said gripping surface on said second jaw, at least one unitary plate having three lobes, one of said lobes is connected to said first and second jaws by a single pin, another of said lobes being connected to said first handle, and another lobe being connected to a second handle, said first handle having at least a partially hollow portion, said adjustment means being disposed at least partially within said hollow portion on said first handle, said second handle having at least a partially hollow portion, a locking lever having one end pivotally attached within said hollow portion on said second handle, and said locking lever having another end which engages said adjustment means, said second handle being moved from a first position to a second position with respect to said first handle, when in said first position, said gripping surface on said first jaw is spaced from said gripping surface on said second jaw, and when in said second position, said gripping surface on said first jaw is closely adjacent said gripping surface on said second jaw.

2. The adjustable locking pliers as claimed in claim 1, wherein said adjustment means is screw threaded.

3. The adjustable locking pliers as claimed in claim 1, wherein when said second handle moves from said first position to said second position, said second handle moves said at least one plate in a first direction by means of its engagement with one of said lobes, and movement of said at least one plate forces said first jaw to rotate, in said first direction, about said curved abutment surface on said first jaw, and when said second handle moves from said second position to said first position, said second handle moves said at least one plate in a second direction which is opposite from said first direction.

4. The adjustable locking pliers as claimed in claim 1, wherein there is another plate in addition to said at least one plate, and said another plate has three lobes.

* * * * *